US005851979A

United States Patent [19]

Scialla et al.

[11] Patent Number: 5,851,979

[45] Date of Patent: Dec. 22, 1998

[54] PSEUDOPLASTIC AND THIXOTROPIC CLEANING COMPOSITIONS WITH SPECIFICALLY DEFINED VISCOSITY PROFILE

[75] Inventors: Stefano Scialla; Sergio Cardola; Giulia Ottavia Bianchetti, all of Rome, Italy

[73] Assignee: The Procter & Gamble Company, Cincinnati, Ohio

[21] Appl. No.: 826,321

[22] Filed: Mar. 27, 1997

Related U.S. Application Data

[63] Continuation of Ser. No. 424,311, Apr. 26, 1995, abandoned.

[30] Foreign Application Priority Data

Nov. 16, 1992 [EP] European Pat. Off. ..... 92870188
Jun. 1, 1993 [EP] European Pat. Off. ..... 93870091

[51] Int. Cl.[6] ..... C11D 17/00; C11D 3/20; C11D 3/395

[52] U.S. Cl. ..... 510/417; 510/191; 510/238; 510/284; 510/372; 510/406; 510/422; 510/434; 510/477; 510/506

[58] Field of Search ..... 510/421, 422, 510/434, 477, 506, 372, 417, 406, 191, 238, 284

[56] References Cited

U.S. PATENT DOCUMENTS

| | | | |
|---|---|---|---|
| 3,904,544 | 9/1975 | Clark et al. | 252/301.2 |
| 3,962,115 | 6/1976 | Clark et al. | 252/301.23 |
| 4,576,728 | 3/1986 | Stoddart | 252/102 |
| 4,648,987 | 3/1987 | Smith et al. | 252/559 |
| 4,743,395 | 5/1988 | Leifheit | 252/106 |
| 4,764,302 | 8/1988 | Baker et al. | 252/301.23 |
| 4,772,290 | 9/1988 | Mitchell et al. | 8/107 |
| 4,818,427 | 4/1989 | Altenschoepfer et al. | 252/174.21 |
| 4,842,771 | 6/1989 | Rorig et al. | 252/547 |
| 4,900,469 | 2/1990 | Farr et al. | 252/96 |
| 4,965,009 | 10/1990 | Baur et al. | 252/142 |
| 5,232,632 | 8/1993 | Woo et al. | 252/546 |
| 5,409,632 | 4/1995 | Showell et al. | 510/372 |
| 5,536,438 | 7/1996 | Scialla et al. | 510/372 |
| 5,559,090 | 9/1996 | Scialla et al. | 510/303 |
| 5,559,091 | 9/1996 | Geboes et al. | 510/422 |

FOREIGN PATENT DOCUMENTS

| | | | |
|---|---|---|---|
| 2134132 | 8/1984 | United Kingdom | C11D 1/83 |

*Primary Examiner*—Ardith Hertzog
*Attorney, Agent, or Firm*—Robert B. Aylor

[57] ABSTRACT

Pseudoplastic and thixotropic aqueous compositions comprise a detergent system containing an emulsion of at least two nonionic surfactants, preferably alkoxylated alcohols of the formula $RO(E)_e(p)_pII$ where R is a hydrocarbon chain of from about 6 to about 20 carbon atoms, E is ethylene oxide, and P is propylene oxide, and e and p represent the average degrees of ethoxylation and propoxylation, said nonionic surfactants having a difference between HLB values of at least 6.5, said composition having a viscosity of from about 60 cps to about 1500 cps at 12 rpm, from about 40 cps to about 800 cps at 30 rpm, and from about 20 cps to about 500 cps at 60 rpm, and said composition preferably having a pH of from 0 to about 6.

4 Claims, No Drawings

PSEUDOPLASTIC AND THIXOTROPIC CLEANING COMPOSITIONS WITH SPECIFICALLY DEFINED VISCOSITY PROFILE

CROSS-REFERENCE TO RELATED APPLICATION

This application is a file wrapper continuation of our application Ser. No. 08/424,311, filed Apr. 26, 1995, now abandoned.

TECHNICAL FIELD

The present invention relates to cleaning compositions, which are particularly suitable for the pretreatment of laundry or the cleaning of hard surfaces, especially inclined surfaces.

BACKGROUND

It is well known in the art that cleaning compositions may advantageously be more or less viscous. Indeed, viscous products do not run like thin liquids, and their use is therefore easier to control. Of course, this aspect is of a lesser importance when the product merely needs to be poured into a machine dispenser or a washing device, but it is critical when the dispensing of the product needs to be controlled, i.e. from a dispenser onto a precise area, say a fabric or a hard surface, where the product is to achieve an effect before it is eliminated. Typically such uses include laundry pretreatment and hard surface cleaning. In such uses, it is important that the product be thick enough so that it clings onto surfaces instead of freely spreading. This is even more critical for products which are to be used on inclined or even vertical surfaces such as bath tubs or toilet bowls.

However, such products also need to be easy to dispense from their container onto the surface. Thus the product also needs to be as thin as possible for an easy dispensing. This requirement is even more critical for products which are sold in containers which have a rather small dispensing orifice, and which are typically used for hard surface cleaners and particularly toilet bowl cleaners. Such small dispensing orifices are indeed needed to be able to dispense the product under the toilet rim. This latter requirement for a thin product is clearly incompatible with the previous requirement hereinabove.

Furthermore, it is highly desirable that such products be easy to rinse off the surfaces once they have acted on them. This requirement also tends towards the formulation of a thin product, rather than thick.

Typically, manufacturers of such cleaning compositions have attempted to solve this incompatibility by adopting a middle term, i.e. formulating compositions which are thick enough to provide some cling onto surfaces, but thin enough to be more or less easily dispensed from their container, and rinsed off the surfaces on which they are used. This approach typically results in products for which neither ease of dispensing nor cling are optimum.

It is an object of the present invention to solve this major incompatibility and provide cleaning compositions which are very easy to dispense, which provide a strong cling onto the surfaces on which they are used, and which are easy to rinse off.

SUMMARY OF THE INVENTION

We have now found that this object is achieved by formulating pseudoplastic and thixotropic cleaning compositions comprising a detergent system, said composition having a viscosity of from 60 cps to 1500 cps at 12 rpm, from 40 cps to 800 cps at 30 rpm, and from 20 cps to 500 cps at 60 rpm.

The present invention further encompasses said compositions contained in a squeezable container equipped with a dispensing nozzle.

The present invention also encompasses a process of treating fabrics and surfaces, where said compositions are used.

DETAILED DESCRIPTION OF THE INVENTION

In its broadest aspect, the invention encompasses cleaning compositions which are pseudoplastic and thixotropic. By pseudoplastic, it is meant herein a composition which has different viscosities when different shear stresses are applied within the limits claimed herein. Different shear stresses can be applied to a given composition for instance by varying the shear rate e.g. the rotation speed of the spindle of a rotational viscometer. Unless otherwise specified, all viscosities herein are measured with a Brookfield DV II rotational viscometer, with spindle No.2 at 20° C. Typically, when running viscosity measurements on pseudoplastic liquids with a rotational viscometer, some fluctuation may occur in the viscosity readings at the beginning of the measurement. After a while, these fluctuations dampen and the viscosity reading becomes stable. At this stage, the system has reached its equilibrium viscosity value. The time needed to reach the equilibrium viscosity value increases with the viscosity of the system. The equilibrium viscosity value stays substantially constant for a period of from 5 to 30 minutes. Unless otherwise specified, all viscosities herein are equilibrium viscosity values.

The compositions herein are furthermore thixotropic, i.e. after having reached equilibrium viscosity, which is typically maintained for a period ranging from 5 to 30 minutes, the viscosity starts to decrease and eventually reaches a second equilibrium value, lower than the first one.

The compositions according to the present invention, which comprise a detergent system, have a viscosity of from 60 cps to 1500 cps at 12 rpm, from 40 cps to 800 cps at 30 rpm, and from 20 cps to 500 cps at 60 rpm. In a preferred embodiment, the compositions herein have a viscosity of from 400 cps to 600 cps, most preferably 450 cps to 550 cps at 12 rpm, from 200 cps to 350 cps, most preferably from 300 cps to 350 cps at 30 rpm, and from 100 cps to 250 cps, most preferably from 150 cps to 250 cps at 60 rpm. The ranges mentioned hereinabove for different shear rates overlap, but it is to be undertsood that for any given composition, the viscosity at 12 rpm will be higher than the viscosity at 30 rpm which, in turn, is higher than the viscosity at 60 rpm. The preferred compositions herein have a viscosity difference between 12 rpm and 30 rpm of at least 20 cps, preferably 300–100 cps, and a viscosity difference between 30 rpm and 60 rpm of at least lOcps, preferably 30–80 cps.

According to the viscosity profiles hereinabove, the compositions according to the present invention have a higher viscosity at lower shear stresses and a lower viscosity at higher shear stresses. Such a viscosity profile allows firstly an easy and precise control of the dispensing of the composition. Indeed, as the composition is dispensed from its container, a high shear stress is applied which contributes to decreasing the viscosity of the composition. Thus the composition according to the present invention has a lower viscosity as it is dispensed.

During the dispensing step, a higher shear stress can be applied by using squeezable containers equipped with dispensing nozzles having a smaller orifice. Indeed, in such containers, the composition is forced out of the container and a higher shear stress is applied than if the product was simply poured from the container. Accordingly, the present invention further encompasses a package comprising a composition as described herein, packaged in a squeezable container equipped with a dispensing nozzle. By squeezable container equipped with a dispensing nozzle, it is meant herein a container wherein substantially no dispensing of the composition occurs unless said composition is squeezed out of said container. Squeezable containers are well known and are commonly used to package toilet bowl cleaning compositions and other hard surface cleaning compositions.

Once the composition has been dispensed onto a surface, no shear stress is applied anymore, apart from a weak stress caused by gravity, and the viscosity of the composition raises. Thus the composition according to the present invention has a higher viscosity once it has been dispensed onto a surface. Accordingly, the composition is prevented from overly spreading on said surfaces, and running down said surfaces too quickly when said surfaces are inclined or even vertical. In addition, as the composition is rinsed or removed, a shear stress is applied which further reduces the viscosity of the composition, thus further easing its removal or rinsing.

Furthermore, the compositions according to the present invention are thixotropic. Accordingly, the compositions according to the present invention show a viscosity decrease of up to 60% at a constant shear rate (rotational speed), preferably from 5% to 50%, most preferably from 10% to 40%. These percentages refer to the difference between the first and second equilibrium values. This thixotropic behavior allows the viscosity of the composition of the invention to decrease with time once it has been dispensed onto the surface where it acts, contributing to an even spreading of the composition on the surface. Furthermore, this thixotropic behavior contributes to a composition which is easier to remove or rinse off said surface.

The compositions according to the present invention are prepared in the form of an aqueous matrix comprising an emulsion of at least two, preferably only two, nonionic surfactants. Said two nonionic surfactants must have different HLB values, and preferably the difference in value of the HLBs of said two surfactants is of at least 3, preferably at least 6.5.

Suitable nonionic surfactants for preparing compositions according to the present invention are alkoxylated alcohol nonionic surfactants which are well known in the art. By varying the chain length of the alcohol and the degree of alkoxylation, a multitude of nonionic surfactants can be obtained with a great variety of different HLBs. Appropriately combining at least two of said nonionic surfactants, with different HLBs, in water allows to form the desired emulsion.

Such alkoxylated alcohols can be readily made by condensation processes which are well known in the art, but a great variety of such atkoxylated alcohols, especially ethoxylated and/or propoxylated alcohols is also conveniently commercially available. Surfactants catalogs are available which list a number of surfactant, including nonionics, together with their respective HLB values.

Accordingly, preferred alkoxylated alcohols for use herein are nonionic surfactants according to the formula $RO(E)_e(P)_pH$ where R is a hydrocarbon chain of from 6 to 20 carbon atoms, E is ethylene oxide and P is propylene oxide, and e and p which represent the average degree of, respectively ethoxylation and propoxylation, are of from 0 to 60.

To obtain an emulsion according to the present invention, i.e. with the desired viscosity profile, it is typically required to use from 4% to 30% by weight of the total composition of said nonionic surfactants, preferably from 6% to 15%. The hydrophobic nonionic surfactant (HLB typically from 6 to 10) should represent from 70% to 90% of the total surfactant amount, preferably from 75% to 85%.

In a preferred embodiment, however, at least one said alkoxylated alcohols herein has an R group in the formula above which has a hydrocarbon chain with only from 8 to 13 carbon atoms, preferably from 8 to 11. The advantage of using such short chain nonionic surfactants is that a pseudoplastic and thixotropic emulsion according to the present invention can be achieved with a lower total amount of surfactant, compared to the same system using longer chain nonionic surfactants. Accordingly, when such short chain nonionic surfactants are used, the compositions according to the present invention need only comprise from 2% to 9% by weight of the total composition, preferably from 3% to 6% by weight of the total composition of said short chain nonionic surfactants.

For appropriate physical stability, emulsions according to the present invention need to be formulated at a pH of from 0 to 6, preferably 0.5 to 4. The pH of the emulsions according to the present invention can be trimmed by all means available to the man skilled in the art. The pH of the emulsion can be trimmed by appropriate organic or inorganic acids which physically stabilize the emulsion and may build up viscosity. A preferred such acid for use herein is citric acid, typically from 1% to 20% by weight of the total composition.

Emulsions according to the present invention typically comprise from 10% to 95% by weight of the total composition of water, preferably from 70% to 85%. Preferably deionized water is used.

Depending on the end use envisioned, emulsions according to the present invention may further comprise a variety of other ingredients including other surfactants of all types, bleaching agents, bleach activators, organic or inorganic alkalis, enzymes, builders, chelants, optical brighteners, dye transfer inhibiting agents, perfumes and dyes.

The compositions according to the present invention are particularly useful as laundry pretreaters, i.e. compositions which are dispensed and left to act onto fabrics before they are washed, or as hard surface cleaners. Compositions according to the present invention find a preferred application in the cleaning of inclined or vertical surfaces, particularly bath tubs and toilet bowls.

Accordingly, the present invention further encompasses a process of treating fabrics or surfaces wherein a pseudoplastic and thixotropic cleaning composition as hereinbefore defined, i.e. comprising a detergent system and having a viscosity of from 60 cps to 1500 cps at 12 rpm, from 40 cps to 800 cps at 30 rpm, and from 20 cps to 500 cps at 60 rpm is dispensed from a container onto said fabrics or surfaces, then left to act onto said fabric or surface, then removed by rinsing.

As used in the foregoing paragraph, the expression "treating" includes washing as the compositions according to the present invention comprise surfactants, but it is not exclusive, i.e. other treatments may be performed concurrently such as bleaching and/or disinfecting.

The present invention is further illustrated by the following examples.

EXAMPLES

The following compositions are made by mixing the listed ingredients in the listed proportions. The compositions obtained have a viscosity profile as specified.

Example 1:

| | |
|---|---|
| Dobanol @ 23-3 (R = C12–C13; e = 3, p = 0) | 7.2% |
| Dobanol @ 45-7 (R = C14–C15; e = 7, p = 0) | 1.8% |
| Hydrogen peroxide | 6.0% |
| citric acid | 6.0% |
| water and minors | up to 100% |
| pH = 1 | |
| Viscosity: 80 cps at 12 rpm; 55 cps at 30 rpm; 30 cps at 60 rpm. | |

Example 2:

| | |
|---|---|
| Dobanol @ 23-3 | 7.2% |
| Dobanol @ 91-10 (R = C9–C11, e = 10, p = 0) | 1.8% |
| Hydrogen peroxide | 6.0% |
| citric acid | 6.0% |
| Water and minors | up to 100% |
| pH = 1 | |
| viscosity: 430 cps at 12 rpm; 225 cps at 30 rpm; 125 cps at 60 rpm. | |

Example 3:

| | |
|---|---|
| Dobanol @ 23-3 | 7.2% |
| C8EO4 (R = C8, e = 4, p = 0) | 1.8% |
| Hydrogen peroxide | 6.0% |
| Citric acid | 6.0% |
| Water and minors | up to 100% |
| pH = 1 | |
| Viscosity: 1200 cps at 12 rpm; 680 cps at 30 rpm; 470 cps at 60 rpm | |

Example 4:

| | |
|---|---|
| Dobanol @ 23-3 | 4.8% |
| C8EO4 | 1.2% |
| Hydrogen peroxide | 6.0% |
| citric acid | 6.0% |
| water and minors | up to 100% |
| pH = 1 | |
| viscosity: 470 cps at 12 rpm; 300 cps at 30 rpm; 234 cps at 60 rpm | |

Example 5:

| | |
|---|---|
| Dobanol @ 91-2.5 (R = C9–C11, e = 2.5, p = 0) | 4.8% |
| Dobanol @ 91-10 | 1.2% |
| citric acid | 6.0% |
| Water and minors | up to 100% |
| pH = 1 | |
| Viscosity: 480 cps at 12 rpm; 290 cps at 30 rpm; 190 cps at 60 rpm | |

Example 6:

| | |
|---|---|
| Dobanol @ 91-2.5 | 4.8% |

-continued

| | |
|---|---|
| Dobanol @ 91-10 | 1.2% |
| Citric acid | 6.0% |
| Hydrogen peroxide | 6.0% |
| Water and minors | up to 100% |
| pH = 2.5 | |
| Viscosity: 1020 cps at 12 rpm; 400 cps at 30 rpm; 220 cps at 60 rpm | |

Example 7:

| | |
|---|---|
| Dobanol @ 91-2.5 | 4.8% |
| Dobanol @ 91-10 | 1.2% |
| Citric acid | 2.0% |
| Hydrogen peroxide | 6.0% |
| Water and minors | up to 100% |
| pH = 1 | |
| Viscosity: 332 cps at 12 rpm; 187 cps at 30 rpm; 130 cps at 60 rpm. | |

All compositions in the preceding examples are thixotropic, in that viscosities drop from 10% to 40% at constant rpm.

What is claimed is:

1. A pseudoplastic and thixotropic aqueous composition comprising a detergent system, said detergent system comprising an emulsion of from about 2% to about 9% of at least two nonionic surfactants which are alkoxylated alcohols of the formula $RO(E)_e(P)_pH$ where R is a hydrocarbon chain of from about 6 to about 20 carbon atoms with at least one being from about 8 to about 13 carbon atoms, E is ethylene oxide, and P is propylene oxide, and e and p which represent the average degree of, respectively ethoxylation and propoxylation, are from about 0 to about 6, and wherein the sum of e plus p is at least 2.5, said nonionic surfactants having different HLB values, wherein the difference between said HLB values is at least 6.5, and wherein said composition further comprises a stabilizing amount of from about 1% to about 20%, by weight of the total composition, of citric acid; said composition having a viscosity of from about 60 cps to about 1500 cps at 12 rpm, from about 40 cps to about 800 cps at 30 rpm, and from about 20 cps to about 500 cps at 60 rpm, and said composition has a pH of from 0 to about 6.

2. The composition of claim 1 wherein both of the two alkoxylated alcohol nonionic surfactants have an R group which is a hydrocarbon chain of from about 8 to about 13 carbon atoms.

3. A composition according to claim 1 wherein said nonionic surfactants represent from about 3% to about 6% by weight of the total composition.

4. A package comprising a composition according to claim 1 packaged in a squeezable container equipped with a dispensing nozzle.

* * * * *